United States Patent [19]

Siddoway et al.

[11] Patent Number: 4,617,744

[45] Date of Patent: Oct. 21, 1986

[54] ELONGATED SLOT DRYER FOR WET PARTICULATE MATERIAL

[75] Inventors: Mark A. Siddoway, Houston; James A. Salter, Katy; R. P. Deschner, Sugarland, all of Tex.

[73] Assignee: Shell Oil Company, Houston, Tex.

[21] Appl. No.: 813,325

[22] Filed: Dec. 24, 1985

[51] Int. Cl.[4] ..... F26B 17/12; F26B 11/12; C10L 5/00; C21D 9/70

[52] U.S. Cl. ..... 34/168; 44/10 E; 44/10 J; 34/174; 34/177; 34/179; 432/62; 432/102

[58] Field of Search ..... 432/62, 102; 44/1 G, 44/10 E, 10 J, 33; 34/165, 166, 168, 170, 174, 177, 179

[56] References Cited

U.S. PATENT DOCUMENTS

| | | | |
|---|---|---|---|
| 558,508 | 4/1896 | Metcalf | 34/170 |
| 1,102,714 | 7/1914 | Bornmann | 34/174 |
| 2,227,634 | 1/1941 | Dalin | 83/28 |
| 2,377,943 | 6/1945 | Kennedy | 34/170 |
| 2,671,057 | 3/1954 | McClure | 252/418 |
| 3,339,287 | 9/1967 | Gray | 34/22 |
| 3,795,987 | 3/1974 | Kemmetmueller | 34/168 |
| 3,992,784 | 11/1976 | Verschuur et al. | 34/12 |
| 4,043,763 | 8/1977 | Norman et al. | 44/1 |
| 4,389,796 | 6/1983 | Odman | 34/168 |
| 4,401,436 | 8/1983 | Bonnecaze | 44/1 |

*Primary Examiner*—John J. Camby
*Attorney, Agent, or Firm*—Kimbley L. Muller

[57] ABSTRACT

An elongated slot dryer is disclosed for drying wet solid particulate material. The slot dryer is constructed in the form of a trench with at least one aperture outlet at the bottom of the trench formed by two non-connecting walls. The wet particulate material (coal) enters through the top and exits through the bottom aperture while countercurrently contacting a drying fluid emitted through perforations situated in a drying fluid access means or conduit located substantially throughout the entire length of the slot dryer. The perforations in the fluid access means or conduit are limited to the bottom one half of the fluid access means relative to the aperture outlet to ensure that drying fluid is passed at first in a downward direction and then gently turns upward to countercurrent contact with the wet descending particles. An underlying conveyor will act to continuously remove the relatively dried particulate material passing through the aperture outlet. The elongated slot dryer provides an extremely efficient use of the drying fluid while eliminating problems of pressure drop throughout the slot trench drying vessel.

33 Claims, 6 Drawing Figures

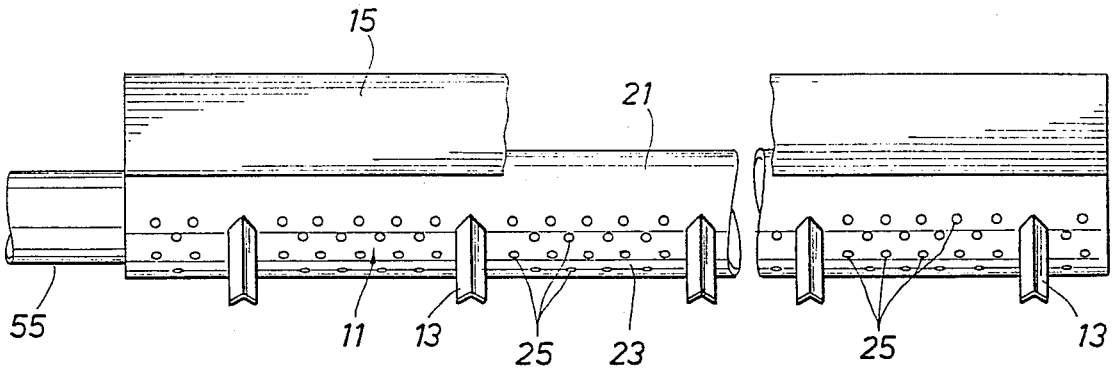
FIG. 3
FIG. 4
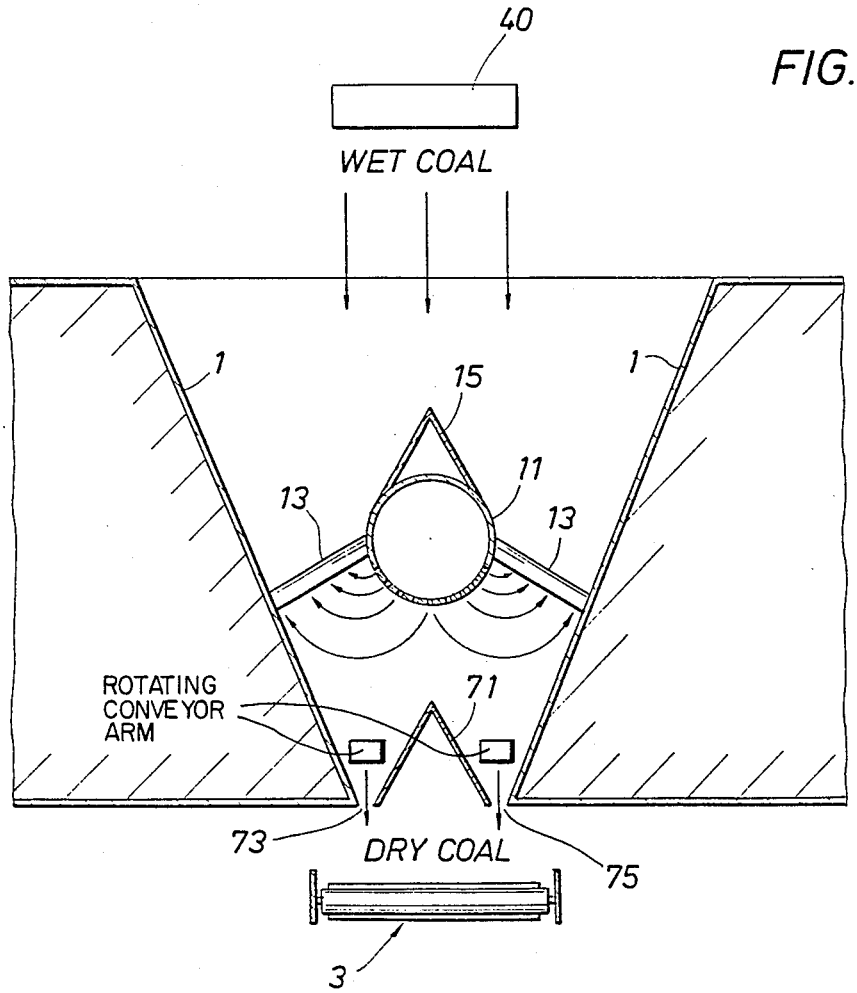

ELONGATED SLOT DRYER FOR WET PARTICULATE MATERIAL

FIELD OF INVENTION

This invention relates to an apparatus for drying wet particulate matter such as sub-bituminous and lignite coal. Water weighs approximately 8 lbs. per gallon and thereby adds a high degree of weight to any wet coal material. It has been reasonably estimated that a majority of the coal remaining in the United States is either lignite coal or sub-bitiminous coal. These coals, sometimes referred to as low-rank coals, are mainly located in the western portion of the United States. They contain low sulfur and low ash content, which is highly desirable to avoid problems resultant from burning the coal, such as acid rain, but have a high moisture content which makes transportation of the coal over any appreciable degree of distance very expensive. It is therefore very desirable to upgrade (dewater at least partially) these coals for transportation, handling and storage.

The major problems which must be addressed in drying low-rank coal are the avoidance of spontaneous combustion, prevention of moisture reabsorption, and control of dust. All these problems must be concomitantly vitiated in a relative economically inexpensive manner to arrive at a viable drying technique.

To date, hot combustion gases have been used to drive the moisture from these type of coals by passing the same in contact with the wet coal. Special treatment facilities and apparatus have been devised to make the treating method more economically attractive but no one unit has successfully addressed and vitiated all the problems associated with an economical drying of the coal. At a minimum, combustion gases must intimately contact the coal to provide the most viable drying technique. Generally, the coal is heated to high temperatures to remove water. The hot, dried coal from such a process needs to be cooled in a second vessel so that it will not spontaneously ignite. However, a separate cooling vessel (or cooling step) is not necessary in the instant dryer which discharges coal at a relatively low temperature (>100° F.).

BACKGROUND OF THE INVENTION

It is possible at some times of the year to field dry wet coals in certain areas of the country. However, even in the most arid sections of the United States, field drying is unreliable and consumes a great amount of time and energy for such tasks as loading and unloading the coal off the ground or drying area. The prior art is replete with many methods and apparatus for drying wet coal. One such method is disclosed in Verschuur et al U.S. Pat. No. 3,992,784, issued in 1976, for a process for upgrading wet brown coal by heating at a temperature of at least 150° C. and at a pressure that is higher than the vapor pressure of water at that temperature. The amount of bound water in the patentees' coal, even in a slurry, depends on a higher temperature during treating, i.e. the higher the temperature the more water that will be withdrawn from the coal particles.

A process for stabilizing dried coal was disclosed in Norman et al, U.S. Pat. No. 4,043,763 (1977), which comprises mixing as-mined lignite and sub-bituminous coal with hot, either completely or partially dried lignite or sub-bituminous coal in an amount to produce a weight ratio of dried coal to as-mined coal of from about 1:2 to about 10:1. Another method of in-situ coal drying was disclosed in Seitzer U.S. Pat. No. 4,213,752 (1980) comprising passing wet low-rank coal at room temperature into a moving bed of hot coal at a temperature in the range of 200° to 300° C. at a rate sufficient to maintain partial combustion of the coal in the presence of a gas, containing at atmospheric pressure, 5 to 25% by volume oxygen. Both of these methods are energy intensive. The former uses coal having a moisture level of not more than 10%, while in the latter hot coal must be maintained at 200° to 300° C. for its downstream admixture with the wet low-rank coal. Another process for upgrading lignitic-type coal is taught in Koppelman, U.S. Pat. No. 4,052,168 (1977), wherein the as-mined coal is subjected to an autoclaving treatment. This, of course, is a capital intensive process since pressure vessels are needed.

Many apparatus have been devised for permitting the contact of hot combustion gases with wet coal particles. Some of these apparatus concern spiral or rotary type dryers while others comprise various modifications of these units as well as upright fluid bed contacting systems. As early as 1914 a patent issued to Bornmann U.S. Pat. No. 1,102,714 teaching the passage of heated gas in a cocurrent manner with the direction of flow of wet coal wherein the apparatus has a baffle to direct the flow of the coal particles through the dryer before their withdrawal through a bottom outlet. The patentee teaches that by the adjustment of the thickness of the layer of coal via the baffle the saturation of the drying air can be correspondingly and accurately adjusted. Twenty seven years later, in 1941, U.S. Pat. No. 2,227,634 issued to Dalin disclosive of a method of conditioning grain. A drying coil is provided for removing moisture (if it is excessive) in the top part of the holding tank, which is fed through the bottom of a truncated funnel area via a moveable gate or valve in the bottom of same.

U.S. Pat. No. 4,401,436, issued to Bonnecaze, in 1983 teaches a process for drying of coal by taking advantage of the combustion of coal fines. After drying, but before cooling, the coal is oxidized in a special oxidizing vessel as shown in FIG. 3 of that patent. Air, which is the most economically efficient oxidizing agent, can be added to oxidize the coal by means of a special air distribution system which is further exemplified in FIG. 5. Also in 1983, U.S. Pat. No. 4,389,796 issued to Odman for a heat exchanger wherein heated air and particulate material both pass through the top of a drying vessel cocurrently after which the heated air egresses downwardly into a bed of the particulate material and then flows in an upward direction through the particulate material causing the desired heat exchange. The cool gas will contact the hot particulate materials thereby warming the former and cooling the latter. The cooled particulate material flows in a downward direction through a conical intermediate shape and exits a truncated portion of the conical vessel via a tubular upper part.

The instant invention uses an elongated conduit which is positioned horizontally with respect to the flow of wet coal as opposed to Odman's vertical orientation. Also, the wet particulate coal is added to a more or less even pile and not to the top of an annular conveyer. In fact, the method of addition of Odman will pose problems of flowability of the coal due to the constricted inlet.

The open air outlet of the patentee's gas inlet tube will not and could not function to evenly distribute air evenly along the length of the dryer, i.e. a perforated outlet is necessary on the horizontal gas inlet tube to perfect proper admission of the air supply to the falling wet coal. For example, if the elongated air supply tube used only a simple opening at the bottom of the horizontal tube then nearly all the gas would exit the horizontal tube at a point juxtaposed to the inlet manifold.

The patentee has a spent air outlet within the confines of his vessel. The invention of this application permits the spent air, after drying, to egress from the top of the V-shaped trench into the ambient atmosphere, although the discharged vapors are subject to appropriate scrubbing by means of a collecting hood. Thus, in the instant apparatus, exit velocities are low and dust entrainment is minimized which are advantageous.

A big advantage of this invention is that pressure drop problems in the apparatus are greatly minimized. In the patentee's apparatus the outlet area of the gas is greatly restricted since it must pass up through the annular tube to the point of discharge. This causes high gas velocities in the area and high pressure drop. The instant apparatus provides for continually expanding areas for gas flow once same exits the elongated air supply tube. This reduces pressure drop.

Apparatus generally disclosed for contacting solids with gases, such as Odman, are classified in many areas of technology in the Patent Office Classification Manual, i.e. Classes 34 and 422. In the applicable subclasses of Class 34, Gray U.S. Pat. No. 3,339,287 and McClure U.S. Pat. No. 2,671,057 are disclosive of gas-solid contacting apparatus. In the latter, solids flow through an inlet at the top and an outlet at the bottom and intermittently contact gas through a series of louvers situated in communication with a central gas manifold. In this manner, the particles moving downward are contacted with a nearly radial flow of gaseous material. A series of interrelated baffles act as a gas egress means and form one dimension of the downward moving solid particulate material (catalyst). A conduit is provided in the bottom of McClure for the augmentation of a stripping media to the solid particulate matter to remove any hydrocarbonaceous material entrained therein.

In the former patent free flowing material contacts a rising gas supply. A multitude of formed cells are provided for drying downwardly passing solid material via upwardly flowing hot gases. The contact is increased as material falls from one unit through to another. Electric elements enhance drying by boiling water off the material being dried.

Air is simply not forced through the descending material. The multiple troughs present structural problems due to sheer size. The continuous dropping of coal particles through the multiple troughs would create severe dust problems not presented by the instant apparatus. In fact, the latter even serves as a granular-type filter media to prevent, not encourage, dust particles from becoming airborne.

All of the above references, even though replete with different techniques for contacting wet particulate material with hot dry gas, have failed to disclose or teach an apparatus for shallow slot drying of wet coal in a trench in a manner such that the temperature of the hot gaseous medium can be regulated to mitigate problems of spontaneous combustion and dust while maximizing the heat exchange coefficient of the heated gas upon the coal particulate material. In this manner, the instant slot drying apparatus does not necessitate or require any cooling step for the coal egressing from the relatively dry outlet while mitigating problems of pressure drop of the drying air passing upwardly through the countercurrent flow of wet coal.

OBJECTS AND EMBODIMENTS OF THE INVENTION

It is an object of this invention to provide an apparatus for the economic drying of wet particulate material in the presence of a drying fluid having an inlet temperature of no more than 300° F.

Another object of this invention resides in an apparatus and method for shallow drying of coal. That is, less than 50% and preferably less than 20% of the total moisture content present in the coal is removed by this process.

It is another object of this invention to provide a drying apparatus comprising a slot trench oven to ensure the most efficient possible heat exchange of the drying fluid to adequately dry the greatest throughput of coal at the lowest temperature possible so that the coal egressing from the outlet does not necessitate cooling before transportation.

Another object of this invention is to provide a slot dryer in the form of an elongated and truncated V-section for drying wet coal in an efficient manner to continuously reclaim relatively dry coal having a lower moisture content using a series of perforations on the bottom of a hollow drying tube conduit so that drying fluid passes ohly through the lower one half of the drying tube conduit. Flow from the conduit will be grossly evenly distributed along the length of the slot dryer by appropriate placed and sized perforations so that flow out of each few foot long section of the conduit is approximately the same. In this manner, air egressing will first cocurrently contact the wet coal particles and subsequently gently turn upward and contact the coal material in a countercurrent manner. The spent heating fluid egressing through the top of the slot trench dryer is at the lowest economical heat exchange coefficient after having performed its appointed task.

It is yet another object of this invention to provide an elongated slot dryer having a movement means for the movement of wet coal material over a baffle-surmounted hollow elongated drying fluid conduit wherein the drying fluid substantially contacts the wet coal in first cocurrent and then countercurrent contact throughout the upper portion of the truncated inverted conical trench.

In one aspect an embodiment of this invention resides in a slot dryer for drying solid particulate material having two slanted side members and therebetween a wet solid particulate material inlet at the top and a dry solid particulate malterial outlet at the bottom. The inlet consists of addition of wet material coal to a free fall section. For example, a tripper conveyer could be used to force the wet material off a moving belt. The material would then free fall to the top of the slot drying section. Wet solid particulate material enters said dryer from the inlet at the top and flows downward through said slot dryer to egress in a relatively dry state through said bottom outlet; wherein said bottom outlet is defined by (1) a pair of non-connecting walls, one wall situated at an acute angle with respect to a horizontal plane extending perpendicular from said outlet flow and one wall situated at an obtuse angle with respect to the same horizontal plane and (2) a pair of connecting walls of shorter height than either of said pair of non-connecting walls, said intersection of connecting walls forming a Λ-shape situated interbetween said non-connecting walls. A shaking means is placed at the bottom outlet to cause turbulence in said wet solid particulate material and to thereby aide in the passage of said wet particulate material from the top of said slot dryer to the outlet of said slot dryer; wherein the relatively-dry solid particulate material outlet is an aperture formed between the pair of non-connecting walls and between the two pairs of connecting walls in the Λ-shape. In general, there may be several such coal outlets along the length of the dryer. An elongated hollow pipe is located transverse to the vertical axis of said slot dryer and situated substantially parallel to said bottom outlet and the non-connecting walls. The hollow pipe has openings therein for passage of a drying fluid therethrough, said elongated hollow pipe being in communication with a drying fluid access means and being supported by support means in communication with one or more non-connecting walls, connecting walls or a baffle attached to either the connecting or non-connecting walls of said slot dryer, wherein said apertures in said elongated hollow tube are situated only in not more than the lower one-half of said elongated hollow pipe closest to the dry solid particulate outlet at the bottom of said dryer to provide passage of said drying fluid in a direction down and outward with respect to the flow path of particulate material to insure first cocurrent and then countercurrent contact of said descending wet particulate material with said drying fluid.

Another specific embodiment of this invention resides in an apparatus for economically drying wet coal to relatively dry coal which comprises an elongated trench of at least 50 feet and preferably at least 100 feet having continuous sloping non-connecting outer walls preferably positioned at an angle of between 50 to 70 degrees and 110 to 130 degrees respectively to the horizontal and having between said sloping walls, at a point juxtaposed to the closest distance between said outer walls an elongated Λ-shape having sides of relatively equal length to provide two outlet apertures each defined by one sloping non-connecting wall and one side wall of said elongated Λ-shape, with an elongated drying fluid access means having perforations for fluid egression into said trench only in the lower one-half or preferably lower one-third of said access means closest to the two aperatures of said trench and wherein the inlet to said trench of wet coal is formed by the greatest upon distance between said sloping walls. The material free falls onto a pile defined by the sloping non-connecting walls.

Yet another specific embodiment of this invention resides in an apparatus for drying wet coal which comprises an elongated trench having an elongated V-section shape with an inlet in the top of said trench for admission to said trench of said wet coal and an outlet in the bottom of said trench for removal of relatively dry coal having an opening of less width than the opening of said inlet; a coal throughput movement means in communication with said elongated trench; an elongated drying fluid hollow conduit situated in said trench in a plane substantially parallel and in a position elevated with respect to said dry coal outlet means and; multiple perforations situated in the lower one-half and preferably the lower one-third of said elongated drying fluid hollow conduit closest to the direction of said relatively dry coal outlet in said bottom of said elongated trench for passage of drying fluid in a downward path in cocurrent contact with said wet coal and wherein said drying fluid, gradually turns in an upward direction to countercurrent contact with said coal.

BRIEF DESCRIPTION OF THE INVENTION

Succinctly, this invention relates to a slot dryer for wet particulate material, especially coal, in the shape of a truncated inverted conical section wherein wet coal enters the top of the truncated conical section and initially passes countercurrently with respect to drying fluid emitted from a specific type of drying fluid conduit means and, wherein said coal egresses from the bottom of the truncated conical section in a relatively dry manner.

BRIEF DESCRIPTION OF THE DRAWINGS

FIG. 3 is a side view of the hollow elongated fluid access means having perforations only in the bottom one half of the pipe.

FIG. 4 is a cross section view of a slot dryer similar to FIG. 1 with the movement means comprising an inverted Λ-shape in the truncated portion of the inverted cone.

DETAILED DESCRIPTION OF THE INVENTION

Figure 1:
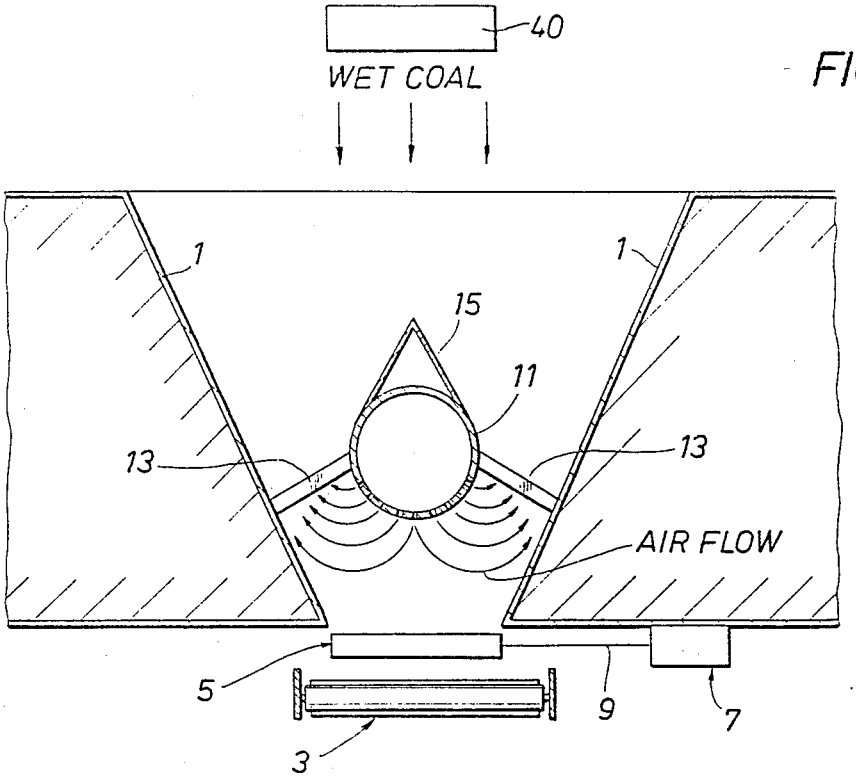
FIG. 1 is a cross section view of the slot dryer.

FIG. 1 shows a cross sectional view of the instant elongated slot drying oven. Wet coal is brought in and admitted to the portion of the truncated conical section having the greatest distance between the V-sloped sides. The wet coal free falls onto the top of the dryer section. As wet coal is admitted, relatively dry coal exits the outlet which is formed by the truncated portion of the V-section. The drying fluid is supplied by an elongated hollow drying fluid access means which can be a piper or other similar conduit of substantially hollow makeup with drying fluid passing therethrough, usually heated air or the like, at a temperature of up to 300° F. The shallow pile configuration of the truncated V is continuous although it is contemplated that intermittent baffles may be placed in the slot dryer for support or for separation of the slot dryer into different zones.

The sides of dryer 1 rest on either a man-made foundation, such as concrete, or on the ground or on a combination of both. These sides are each from 30 feet to 200 feet high and at least 50 feet long. Coal in a relatively dry state is discharged from the slot dryer and carried away on endless conveyor 3 usually to a position elevated with respect to the bottom of the slot dryer, and to loading in coal cars or the like for desired "dry-state" transportation. The coal could be treated for dust suppression by spraying a liquid onto it after it is dried and before it is loaded for shipment. The coal could also be combined with other wet material from the mine (e.g., fines). A movement means, which may comprise a vibrator or continuously reaching arms into the slot dryer, is provided at 5 with power adaptation shown at 7 through power transfer means 9. A substantially hollow elongated tube 11 transverses the near entire length of the slot dryer. This length may be up to 1000 feet long or it may be as short as 50 feet. If a manifold for admitting drying gas into the hollow tube or conduit is supplied on both ends or along the length of the dryer, then the maximum length could be multiplied. Throughout transverse passage of the elongated trench, the hollow drying fluid access means is supported by one or many support means 13. Drying fluid having a temperature of up to 300° F. passes through elongated hollow conduit 11 and egresses into the bed of wet coal particles through a multiple number of perforations situated only in the lower one half of the elongated conduit. In this manner the warm drying fluid moves in a direction co-current with respect to the passage of the coal for a short period of time and then rises and thereby passes countercurrent with respect to descending wet coal particles. The depth of the trench and the depth of the drying fluid access means are important factors to consider in situating the drying fluid access means to minimize pressure drop of the drying fluid passing upward through the wet particulate material and to maximize the efficiency of the drying fluid. The perforations are arranged n the bottom of hollow conduit tube 11 having a sloped baffle 15 surmounted thereto to prevent coal from resting on the top of elongated drying fluid conduit 11 and thereby creating a fire hazard via overdrying of the coal material. The perforations are located in the bottom one-half (or preferably one-third) of the conduit to prevent coal from falling into the tube and thereby creating another fire hazard.

FIG. 3 shows a cross section of the elongated hollow drying fluid access conduit with the top half 21 being totally imperforate while the bottom half 23 contains multiple perforations 25. These perforations can be spaced an equal distance from one another to permit egress of the drying fluid in a uniform pattern therethrough. It is also contemplated that a shotgun approach to situating the perforations can be undertaken by placing in the lower half of the hollow tube multiple perforations or apertures 25 at irregular distance with respect to one another. The drying fluid perforations are preferably no more than ¼ inch in diameter and occupy no more than 50% surface area and at least 1% surface area of the lower one-third of the fluid access means. The air supply conduit is of such design to grossly evenly distribute the flow of air along the length of the bed. This is accomplished by making the pressure drop through the perforations in the bottom of the conduit large enough to evenly distribute the flow. A contemplated distributor would have negligible pressure gradient, and hence with relatively even perforations along the axis of the conduit, drying fluid flow is distributed evenly. In general, the pressure will vary along the axis of the distributor. This can be balanced by changing the hole size in the hollow conduit if so desired. Holes near the inlet manifold (from outside the slot dryer) would be small and cause large pressure drops. Holes far from the inlet manifold would be larger and cause smaller pressure drop. Therefore, the axial pressure drop caused as gas flows along the conduit would be overcome by decreasing resistances to flow through the perforations as the gas flows along the tube. It is also a preferred embodiment of this invention that these apertures be placed only in the lower one third of the hollow conduit to totally prevent coal from falling into the hollow drying fluid access conduit. In addition, another preferred embodiment of this invention resides in an apparatus wherein these apertures are placed in a specified pattern to provide that discharge of the drying fluid from the hollow conduit will uniformly and gently pass up through the wet coal particles but not discharge with sufficient force to flow through the bottom outlet of said slot dryer.

Figure 2:
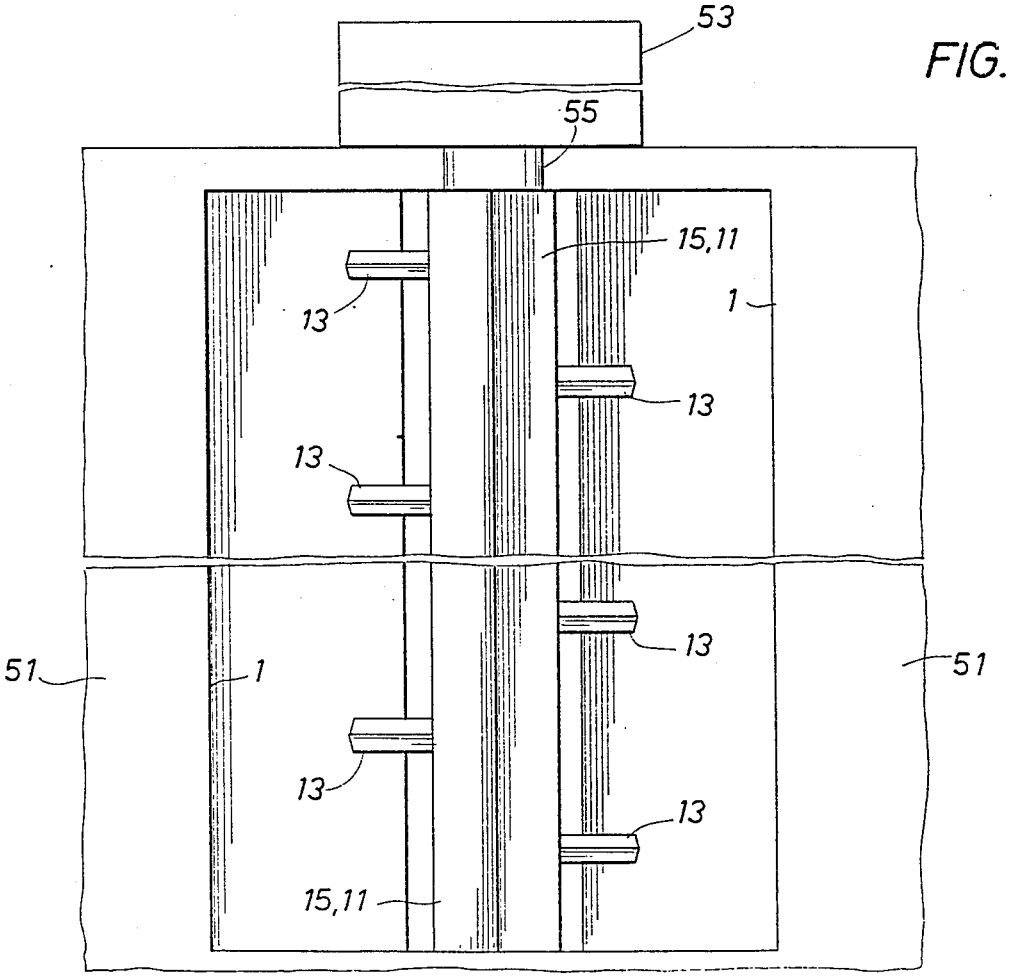
FIG. 2 is an overview of the instant slot dryer with a drying fluid preparation means in communication therewith.

FIG. 2 shows an overview of this system having either man-made or gelogical supports 51 on either side of the side walls 1. In general, a more economical construction will utilize geological supports to the maximum extent possible. The outlet for the relatively dry coal cannot be viewed from this angle. The drying fluid is conditioned in facility 53, which may be a conventional furnace or simply a flue stream derived from hydrocarbon processing, a coal oven or a flue stream from a power generation plant. The heated flue gas is passed to the hollow conduit via conduit 55.

FIG. 4 shows a different embodiment of this invention wherein relatively dry coal outlets are formed by an elongated Λ-shape 71 resulting in aperture outlet openings 73 and 75, which may be of equal or unequal dimension to permit egression of the relatively dry coal particles. The sides of Λ-shape will be 0.5 feet to 15 feet in width while the aperture will be 0.5 feet to 10 between the outer wall and respective side wall of the Λ-shape. The maximum distance in height between the top of the Λ-shape and the fluid drying conduit is between 30 and 200 feet. This baffle can be in the form of a solid triangle or a multitude of solid triangles situated in the bottom of the elongated slot. It is also contemplated that these triangles will be provided with a shaking, vibrating means or extracting means (not shown) to enhance movement of the coal in a downward direction.

Figure 5:
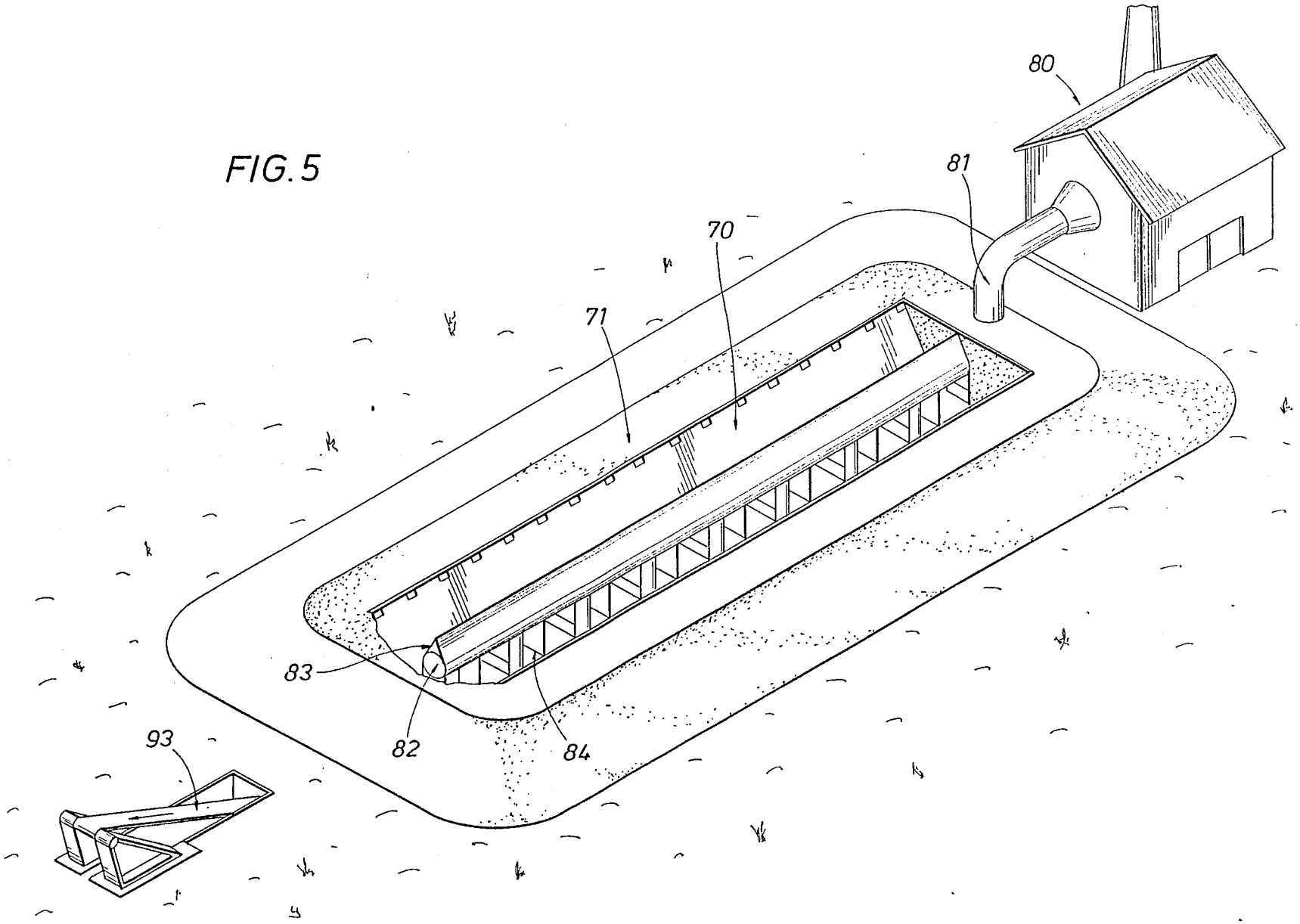
FIG. 5 is an overall view of a slot dryer showing central air ducts and supports.
Figure 6:
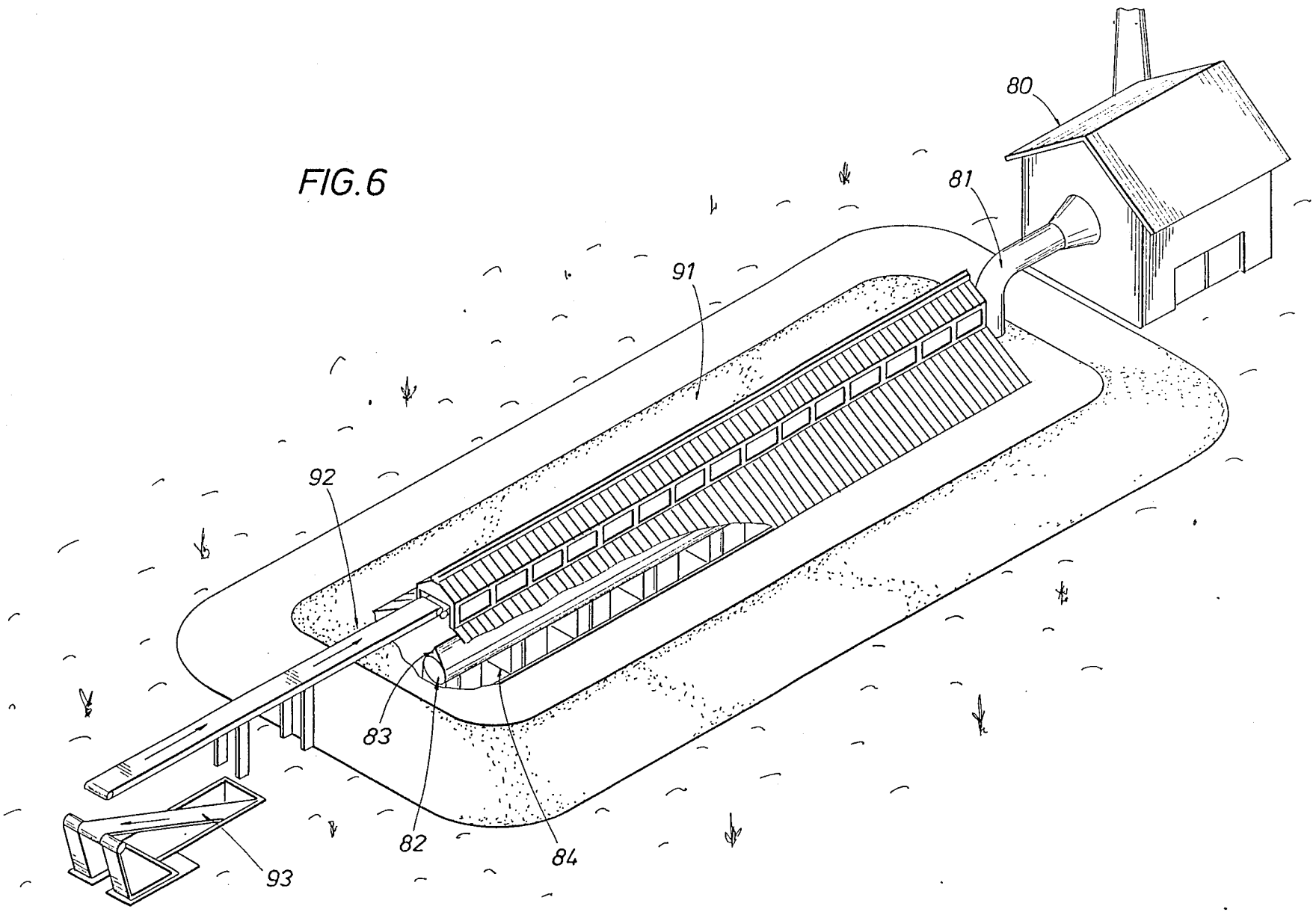
FIG. 6 is an overall view of a slot dryer with specific trip-conveyer feed equipment.

FIGS. 5 and 6 set forth a layout of a specific embodiment of this invention. FIG. 5 shows a cut-out section without a top tripper conveyer and FIG. 6 shows a top tripper conveyer. In FIG. 5, the sides of the slot dryer 70 are supported by the ground 71. A furnace inside of a building 80 is used to supply drying gas at a temperature of not more than 300° F. to tube 81 connected to hollow conduit 82. Conduit 82 is relatively hollow and has perforations along the bottom one-half or the bottom one-third and discharges the drying gas into a trench full of coal supported by the sides of the slot dryer. An elongated inverted V section baffle 83 is placed on top of the drying conduit 82 to help coal flow evenly past the conduit so as to mitigate fire hazards. conduit 82 is supported along its length by supports 84. FIG. 6 shows tripper conveyer 82 surmounted to the top of the slot dryer section. A covering 91 is provided for the slot dryer. Coal is forced off the tripper conveyer 92 and free falls onto the slot drying section. The slot drying section contains the coal and the conduit for distributing the drying gas 82, the elongated inverted V-shaped section 83 on top of the conduit, and the supports for the conduit 84. The material is discharged underneath by either vibrating feeders or a rotary plow (not shown) onto conveyer 93 which removes and elevates the dried coal for possible transportation.

DETAILED DESCRIPTION OF THE INVENTION

The instant apparatus is a slot dryer contained within an elongated truncated conical trench. The instant slot dryer is an apparatus for shallowly drying coarse particles of low rank coal. The drying process in this apparatus could potentially remove 50% of the original moisture in the feed coal. In general, only 1–20% of the total original moisture can be excised from the coal in this apparatus. The moisture removed is both surface moisture and inherent or pore moisture. Wet coal or wet solid particulate material is added to the top of the slot dryer trench at a point in an axial plane equal to the greatest distance separating the side members of the cone. Coal is added into the slot dryer by any type of conveyer, such as a tripper conveyer or an endless conveyer, which evenly distributes the coal along the length of the slot. The feed inlet preferably comprises a relatively open tripper conveyer or similar discharge equipment. The coal free falls nto the drying area. One or several tripper conveyers can be used depending on the width of the slot dryer. The sides of the slot oven are usually made of concrete or some other man-made synthetic material, such as a polymer or the like, which will withstand the constant abrasion resulting from the continuous passage of the coal particles thereon. The sides of the elongated trench have a relatively steep slope, preferably greater than 50°, and preferably from 50° to 70°. The obtuse angle formed by the second wall of the slot or truncated cone will be from 110° to 130° relative to the horizontal axis of the relatively dry coal outlet means in the bottom of the slot. The slot oven may be lined with conventional nonabrasive materials such as stainless steel, high melting plastics, and the like which possess low coefficients of friction to provide for an even flow of the coal. The side walls of the trench do not connect and actually from the sides of what appears to be an extended and truncated V-shaped section. These non-interconnecting walls are preferably of equal length or at least substantially of equal length.

The size of the coal is important to the drying technique. The top size of the coal is from 1 to 20 inches. The bottom size of the coal can be modified by prescreening and can have a size as small as one quarter inch diameter. The bottom size could be made smaller than ¼"; however, smaller screens (than ¼") are subjected to plugging and pose operational problems. The particle size distribution of the coal could be modified by using a uniform primary or secondary crusher before of after drying or by blasting the coal to a uniform size before drying. It is contemplated within the scope of this invention that the elongated trench has a prescreening area to limit nefarious dust created during the handling and the drying of the coal. The coal could also be treated via spraying a liquid onto the coal prior to drying to suppress the spontaneous ignition tendency of the dried product or to supress dusting of the coal during drying. The bed also serves as a granular filter to limit release of dust. At the bottom of the elongated slot dryer is positioned an endless conveyer for the extraction of the relatively dry coal from the bottom of the slot dryer and passage of same to a dry storage area, a crushing process, a blending process, or to a staging area for transportation. In addition, the dried coal could be sprayed with a liquid to suppress dust, spontaneous ignition, or moisture resorption after it is dried. It is preferred that this conveyor be situated at an angle with respect to the horizontal to elevate the relatively dry coal from a point juxtaposed to the coal outlet to a point higher than the top of the elongated slot trench.

The inlet drying fluid is preferably warm air maintained at a temperature of 100° to 300° F. The drying gas outlet temperature at the top of the bed will be less than 100° F. due to cooling that occurs as water evaporates from the coal. The length of the manifold attached to the drying fluid conduit, which runs substantially transverse to the vertical axis of the slot dryer, can be constructed in any configuration and is in direct communication with a source of drying fluid. The drying fluid is distributed to the hollow elongated conduit for passage throughout the horizontal axis of the elongated trench. The drying fluid access means preferably is a hollow pipe that is perforated only along the bottom half or even third of the pipe to prevent particles from falling on or in the apertures of the conduit and also to facilitate better contact of the drying fluid with the descending wet coal particles. In addition, for even distribution of flow and for larger dryers, multiple conduits for distributing the air could be used. As indicated in the aforegoing discussion in re FIG. 3 above, these apertures may be either randomly placed in the conduit or they may be spaced at an equal distance with respect to one another so as to most advantageously direct the flow of the drying fluid up to the slanted side walls of the elongated trench before passage countercurrent with respect to the flow of wet coal in a downward direction.

Over an axial cross section of a few feet in distance, perfectly even distribution of the drying fluid or air flow is not necessary. Air or drying fluid will quickly find channels in the coarse coal. Thus, to decrease construction costs and to provide smaller pressure drops, even distribution over small distances is unnecessary. Only grossly even distribution of the drying gas is necessary. That is, flow out of the conduit does not need to be even over every inch of length. Flow only needs to be even over every few feet of length. Channeling will occur regardless of how the air is distributed. However, these channels will change as the coal flows down the slot, and new faces of coal are exposed to the flow of drying air. The drying fluid perforations are preferably no more than ¼ inch in diameter and occupy no more than 50% of the surface area and at least 1% of the surface area of the lower one-half or one-third of the fluid access means.

It is also contemplated that a guard baffle or shelf be placed above the imperforate half of the drying fluid access means to prevent accumulation of coal particles thereon, which would again create a fire hazard. The number of apertures and placement of the same in the conduit should be situated so as to decrease the overall pressure drop throughout the elongated trench and thereby improve safe operating conditions in an economic manner.

The drying fluid is preferably heated air which could be tempered flue gas from a combustor, heated ambient air or tempered flue gas from a boiler system where steam is used for power generation or the like. The heated fluid passes upward through the bed of descending wet coal and exits the facility into the ambient conditions. If desired the upflow of air may be scrubbed if pollution problems arise in regard to the accumulation of toxic or unpleasant components derived from the coal bed. The gauge pressure of the drying fluid can be easily selected on a practical basis to be up to 50 inches of water and preferably less than 10 inches of water. The desired pressure will be selected depending upon the size and depth of the slot dryer, the number of pipes used to distribute the air, the length of the pipe or pipes used to distribute the drying fluid, the pressure drop across the coal bed and the overall drying rate of the slot dryer.

The velocity of the drying fluid exiting the bed of wet coal particles should be minimized to reduce the amount of particles entrained from the coal bed and to maximize the heat capacity of the drying fluid. The exit velocity can be decreased by minimizing the flow rate of the drying fluid or by maximizing the surface area at the top of the elongated trench. The amount of drying fluid can be minimized by increasing the inlet temperature of the drying fluid or by decreasing the overall drying rate of the slot dryer.

An important advantage of this slot dryer over the above-discussed prior art is that coal egressing therefrom does not necessitate cooling as taught, with or without intermittent oxidation, in Bonnecaze, U.S. Pat. No. 4,401,436. Avoidance of the expensive cooling step is derivative of the low temperature of the drying fluid in the slot trench dryer and its economical use in its passage upward in countercurrent contact with the wet coal. In fact, the maximum temperature of the coal egressing from the relatively dry coal outlet will be no more than a little less than 100° F., and thus, will reduce greatly the fire hazard confronting other drying systems.

The elongated slot dryer will minimize the development of hot spots and resultant fires in the coal bed by providing mass or plug flow of the coal and uniform drying air distribution. It is feasible within the scope of this invention to provide safety snuff steam systems in the slot dryer to inject steam into a hot spot, if detected, to reduce the free oxygen content of the bed below that required to sustain combustion. The steam can be injected directly into the bed or it can be injected external to the dryer and injected into the drying air manifold. In either event it is essential that when hot spots occur, to avoid fires, that the steam be used to deplete the oxygen content in the bed so as to avoid unwanted combustion of coal.

The size of this unit is an important aspect in this drying technique. It is conceivable that this shallow pile depth continuous drying system can have a capacity of up to 20 million cubic feet of coal while drying as much as 240,000 tons per day. In terms of throughput versus time a slot dryer can process up to 200 to 10,000 tons per hour of high tonnage wet coal to relatively dry coal even with a drying fluid having an inlet temperature of no more than 300° F. and preferably between 150° and 250° F. The size of the trench may be from 50 to 1000 feet long and any applicable number of baffles can be placed in the trench parallel to the vertical axis of these slot dryers so as to form multiple chambers of drying areas. It is contemplated that the dryer possess a feet inlet of from 20 to 200 feet wide and a discharge outlet of from 2 to 30 feet wide. The elongated A-shape defining the relatively dry coal outlet has sides of from 0.5 to 15 feet in width. The outlet aperature defined thereby are from 0.5 feet to 10 feet in relation to the distance between the outer wall and the sides of the Λ-shaped configuration. Coal could be charged to the dryer via one or several tripper conveyors or screw conveyors to evenly distribute the coal over the inlet for the coal. The coal is forced off the tripper conveyor and free falls into the drying section. Thus, the inlet would be a relatively open area where coal falls freely by the force of gravity. This apparatus will prevent fines from accumulating in the coal bed and thereby mitigate fire hazards. It will also cause the shifting of the coal particles in a downward direction throughout their drying and processing. In summary, the instant elongated trench dryer provides an economic system for drying coal which eliminates or at least reduces the dust content of the coal caused during drying with less pressure drop and less fines generation than in previous larger and/or rectangular drying systems.

The flow rate of drying gas through the slot dryer is effective to dry the coal but is not sufficient to fluidize the coal. While the drying gas flow will cause movement of some of the fine material, the flow of drying gas will not cause bulk movement of the coarser particles at points remote from the drying gas inlet at the conduit. The velocity of drying gas will decrease as the drying gas travels farther from the air supply conduit. The velocity of the drying gas is high near the inlet points (at the conduit) and continually decreases as the drying gas flows through the slot since the area through which gas flows is ever increasing from the drying gas inlet to the drying gas exhaust.

Again, the slot dryer is for shallow drying of wet coal. Shallow drying is defined as drying not over 50% and preferably not over 20% of the total moisture in the coal. Both surface mositure (free mositure—ASTM D 121-78) and pore moisture (inherent moisture—ASTM D 121-78) are removed by the slot dryer. These amounts of moisture are relatively easy to remove, and the drying gas will quickly saturate, even if there is relatively poor contacting caused by interstitial voids and channels in the wet material. Thus, the coal particles do not need to be heated to a high temperature to extract the water (as is necessary with other drying processes which deeply dry low rank coal). Cooling of the dried coal is not required. The inlet drying gas temperature is up to 300° F., but this gas temperature decreases since cooling of the gas provides the necessary heat for evaporating water, and the exhaust temperature of the drying gas will be less than 100° F.

It is advantageous for the drying gas to channel through voids in the bed since this will minimize the overall pressure drop and minimize the power required to pump drying gas through the bed. Thus, flow must be distributed in only a grossly even manner. That is, every few feet of the drying bed must have equal flow, but the flow does not need to be evenly distributed over every inch long section of the conduit. If the flow was uniformly distributed over every inch section, the drying gas would quickly find channels in the bed due to the nature of beds of coal with coarse particles. Also, the channels change as the coal flows down through the bed; and new, fresh faces of coal particles become exposed to the drying gas.

What is claimed as the invention:

1. A slot dryer for drying solid particulate material having two side members and therebetween a wet solid particulate material inlet at the top and a relatively dry solid particulate material outlet at the bottom, wherein wet solid particulate materials enters said slot dryer and passes downward through said slot dryer to egress in a relatively dry state through said bottom outlet; wherein said bottom outlet is defined by (1) a pair of non-connecting walls, one wall situated at an acute angle with respect to a horizontal plane extending perpendicular from said outlet flow and one wall situated at an obtuse angle with respect to said horizontal plane and (2) a pair of connecting walls of shorter height than either of said pair of non-connecting walls, said intersection of connecting walls forming a Λ-shape situated between said non-connecting walls; a shaking means to cause turbulence in said wet solid particulate material and to aid in the passage of said wet solid particulate material from the inlet of said slot dryer to the outlet of said slot dryer; wherein said relatively-dry solid particulate material outlet has an aperture formed between the pair of non-connecting walls and two connecting walls in the Λ-shape; and one or more elongated hollow conduits located transverse to the vertical axis of said slot dryer and relatively parallel to said bottom outlet, said conduit having operative means therein for passage of a drying fluid therethrough, said elongated hollow conduit being in communication with a drying fluid access means and being supported by support means in communication with said slot dryer, wherein said apertures in said elongated hollow conduit are situated only in not more than the lower one half of said elongated hollow conduit closest to the direction of said relatively dry solid particulate outlet at the bottom of said slot dryer to provide passage of said drying fluid in a direction down and outward with respect to the flow path of particulate material to insure first cocurrent and second countercurrent contact of said descending wet particulate material with said drying fluid.

2. The slot dryer of claim 1 wherein said acute angle is between 50 and 70 degrees and said obtuse angle is between 110 and 130 degrees.

3. The slot dryer of claim 1 wherein said acute angle is 60 degrees and said obtuse angle is 120 degrees.

4. The slot dryer of claim 1 wherein said non-connecting walls are of equal length.

5. The slot dryer of claim 1 wherein said relatively dry solid particulate material at the bottom has an elongated endless conveyor associated therewith to continually remove said relatively dry particulate material away from said bottoms outlet.

6. The slot dryer of claim 5 wherein said endless conveyor is situated beneath the entire bottoms outlet.

7. The slot dryer of claim 1 wherein said elongated hollow conduit has surmounted thereto a Λ-shape baffle to direct passage of the wet particulate matter in a direction away from the imperforate top portion of said elongated hollow conduit.

8. The slot dryer of claim 7 wherein said Λ-shaped baffle is constructed of a pair of connecting planar walls having their apex at a point remote from and above with respect to said imperforate top portion of said elongated hollow conduit.

9. The slot dryer of claim 1 wherein said apertures in said one-half of said elongated hollow conduit comprise a multitude of perforations in said pipe.

10. The slot dryer of claim 9 wherein said perforations are located only in the bottom one-third of said elongated hollow conduit and the upper two-third of said elongated hollow conduit is imperforate.

11. An apparatus for economically drying wet coal to relatively dry coal which comprises an elongated trench of at least 50 feet in length having continuous sloping non-connecting outer walls positioned at an angle of between 50 to 70 degrees and 110 to 130 degrees respectively to the horizontal and having between said sloping walls, at a point juxtaposed to the closest distance between said outer walls, an elongated Λ-shape having sides of relatively equal length to provide two outlet apertures, each defined by one sloping wall and one side wall of said elongated Λ-slope, with an elongated drying fluid access means having perforations for fluid egression into said trench only in the lower one-third of said access means in relation to the two outlet aperatures of said trench and wherein the inlet to said trench of wet coal is formed by the greatest open distance between said sloping walls.

12. The apparatus of claim 11 wherein said trench continues for a distance of up to 1000 feet and is capable of economically drying up to 200–10,000 tons per hour of wet coal using a drying fluid having an inlet temperature of no more than 300° F.

13. The apparatus of claim 12 wherein said throughput per hour of coal is 200–10,000 tons per hour using a drying fluid having an inlet temperature of between 150° and 250° F.

14. The apparatus of claim 11 wherein said continuous sloping non-connecting outer walls are each 30 feet to 200 feet high and at least 50 feet long.

15. The apparatus of claim 11 wherein said elongated Λ-shape has sides of from 0.5 feet to 15 feet in width.

16. The apparatus of claim 11 wherein said outlet apertures have from 0.5 feet to 10 feet between said outer wall and said respective side of said elongated Λ-shape.

17. The apparatus of claim 11 wherein the maximum distance in height between the top of said elongated Λ-shape and said fluid access means is between 30 feet and 200 feet.

18. The apparatus of claim 11 wherein said drying fluid perforations are preferably no more than ¼ inches in diameter and occupy no more than 50% surface area and at least 1% surface area of the surface of the lower one-third of said fluid access means.

19. The apparatus of claim 18 wherein said perforations are positioned to insure that said drying fluid egresses from said perforations in a direction toward said outlet and gently curves upwardly toward the top of said elongated trench in countercurrent contact with said wet coal particles.

20. The apparatus of claim 11 wherein said perforations for fluid egression into said trench are positioned to minimize total pressure drop.

21. The apparatus of claiim 20 wherein said perforations in said elongated drying fluid access means generally become larger in the flow direction opposite fluid entry to said elongated drying fluid access means.

22. The apparatus of claim 19 wherein said wet coal particles are dryed by countercurrent passage of said wet coal particles and exit through either of said outlet apertures in a relatively dry state.

23. An apparatus for drying wet coal which comprises:

a. an elongated trench having walls forming an inverted truncated conical shape with an inlet in the top of said trench for admission to said trench of said wet coal and an outlet in the bottom of said trench for removal of relatively dry coal, said outlet having an opening of less width than the opening of said inlet;

b. a coal throughput movement means comprising a vibration means in communication with said elongated trench and supported from the walls or from beneath the outlet of said inverted conical shape;

c. one or more elongated drying fluid hollow conduit situated in said trench in a plane substantially parallel and in a position elevated with respect to said dry coal outlet means; and d. multiple perforations situated in the lower one-half of said elongated drying fluid hollow conduit with respect to the direction of said relatively dry coal outlet in said bottom of said elongated trench for passage of drying fluid in a downward path in co-current contact with said wet coal and wherein said drying fluid gradually turns in an upward direction to countercurrent contact with said coal.

24. The apparatus of claim 23 wherein said bottom relatively dry coal outlet means has associated therewith an endless conveyor means for continuous removal of said relatively dry coal from a point juxtaposed to said bottom relatively dry coal outlet means.

25. The apparatus of claim 23 wherein said perforations are situated only in the lower one-third of said drying fluid hollow conduit.

26. The apparatus of claim 23 wherein said perforations are present in said lower one-half of said drying fluid hollow conduit to insure grossly equal distribution of said drying fluid throughout said elongated trench at positions juxtaposed to the bottom of said drying fluid hollow conduit and above said drying fluid hollow conduit.

27. The apparatus of claim 26 wherein said perforations are present in the lower one-third of said drying fluid hollow conduit to insure grossly equal distribution of said drying fluid throughout said elongated trench at positions juxtaposed to said bottom of said drying fluid hollow conduit and above said drying fluid hollow conduit.

28. The apparatus of claim 23 wherein said perforations are situated in said lower one-half of said drying fluid hollow conduit in a configuration to provide that the fluid flow countercurrent to said wet coal will be grossly evenly distributed throughout said wet coal.

29. The apparatus of claim 23 wherein said elongated drying fluid hollow conduit has surmounted thereto a deflection baffle formed by two interconnecting planar surfaces to prevent said wet coal from contact with and deposit on said hollow conduit.

30. The apparatus of claim 23 wherein said trench is divided into more than one compartment by means of at least one upright baffle means in communication with the sides of said truncated conical shape.

31. The apparatus of claim 30 wherein said elongated drying fluid hollow conduit communicates with said upright baffle means throughout the substantial length of said trench.

32. An apparatus for drying wet coal which comprises:

a. an elongated trench having walls forming an inverted truncated conical shape with an inlet in the top of said trench for admission to said trench of said wet coal and an outlet in the bottom of said trench for removal of relatively dry coal, said outlet having an opening of less width than the opening of said inlet;

b. a coal throughput movement means comprising a rotating conveyor arm intermittently communicating with said relatively dry coal bottom outlet means;

c. one or more elongated drying fluid hollow conduit situated in said trench in a plane substantially parallel and in a position elevated with respect to said dry coal outlet means; and d. multiple perforations situated in the lower one-half of said elongated drying fluid hollow conduit with respect to the direction of said relatively dry coal outlet in said bottom of said elongated trench for passage of drying fluid in a downward path in co-current contact with said wet coal and wherein said drying fluid gradually turns in an upward direction to countercurrent contact with said coal.

33. An apparatus for drying wet coal which comprises:

a. an elongated trench having walls forming an inverted truncated conical shape with an inlet in the top of said trench for admission to said trench of said wet coal and an outlet in the bottom of said trench for removal of relatively dry coal, said outlet having an opening of less width than the opening of said inlet;

b. a coal throughput movement means comprising a shaker means in communication with said elongated trench to shake said coal as said coal traverses said elongated trench;

c. one or more elongated drying fluid hollow conduit situated in said trench in a plane substantially parallel and in a position elevated with respect to said dry coal outlet means; and d. multiple perforations situated in the lower one-half of said elongated drying fluid hollow conduit with respect to the direction of said relatively dry coal outlet in said bottom of said elongated trench for passage of drying fluid in a downward path in co-current contact with said wet coal and wherein said drying fluid gradually turns in an upward direction to countercurrent contact with said coal.

* * * * *